US008774698B2

(12) United States Patent
Tsuru et al.

(10) Patent No.: US 8,774,698 B2
(45) Date of Patent: Jul. 8, 2014

(54) IMAGE FORMING APPARATUS WITH A TONER RECOVERY UNIT

(75) Inventors: Kenji Tsuru, Hachioji (JP); Teruo Nagashima, Toyohashi (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 173 days.

(21) Appl. No.: 13/372,675

(22) Filed: Feb. 14, 2012

(65) Prior Publication Data

US 2012/0207517 A1 Aug. 16, 2012

(30) Foreign Application Priority Data

Feb. 15, 2011 (JP) ..... 2011-029480

(51) Int. Cl.
*G03G 21/00* (2006.01)
*G03G 21/12* (2006.01)

(52) U.S. Cl.
USPC ..... 399/358; 399/359; 399/360

(58) Field of Classification Search
USPC ..... 399/358–360
See application file for complete search history.

(56) References Cited

U.S. PATENT DOCUMENTS

| | | | | |
|---|---|---|---|---|
| 5,200,787 | A * | 4/1993 | Nishiguchi | 399/359 |
| 5,250,997 | A * | 10/1993 | Kaneko et al. | 399/99 |
| 5,493,382 | A * | 2/1996 | Takagaki et al. | 399/359 |
| 5,638,159 | A | 6/1997 | Kai et al. | |
| 5,737,680 | A * | 4/1998 | Takagaki et al. | 399/359 |
| 6,115,574 | A * | 9/2000 | Mikuriya | 399/258 |
| 6,226,490 | B1 * | 5/2001 | Fujita et al. | 399/359 |
| 6,567,631 | B2 * | 5/2003 | Funayama et al. | 399/120 |
| 6,711,374 | B2 * | 3/2004 | Funayama et al. | 399/359 |
| 7,366,458 | B2 * | 4/2008 | Ishikawa et al. | 399/359 |
| 2002/0064408 | A1 * | 5/2002 | Akiba et al. | 399/359 |
| 2006/0062614 | A1 * | 3/2006 | Choi | 399/358 |
| 2006/0263124 | A1 * | 11/2006 | Ogawa et al. | 399/359 |
| 2012/0093527 | A1 * | 4/2012 | Itagaki et al. | 399/27 |
| 2012/0213543 | A1 * | 8/2012 | Ashikawa | 399/71 |

FOREIGN PATENT DOCUMENTS

| | | | |
|---|---|---|---|
| JP | 57-063554 | A | 4/1982 |
| JP | 59-147375 | A | 8/1984 |
| JP | 06-110329 | A | 4/1994 |
| JP | 3352399 | B2 | 12/2002 |

(Continued)

OTHER PUBLICATIONS

Japanese Office Action (Notification of Reason(s) for Refusal) dated Apr. 16, 2013, issued in corresponding Japanese Patent Application No. 2011-029480, and English language translation of Office Action. (6 pages).

(Continued)

*Primary Examiner* — G. M. Hyder
(74) *Attorney, Agent, or Firm* — Buchanan Ingersoll & Rooney PC

(57) ABSTRACT

In an image forming apparatus wherein a developing unit forms a toner image on an image carrier by using a developer including a toner and a carrier, wherein a toner recovery unit recovers the toner remaining on the image carrier after the transfer of the toner image to a transfer receiving body and wherein the recovered toner is returned to the developing unit by a return transport mechanism, a recovered toner reservoir for storing the toner recovered by the toner recovery unit is disposed independently from the return transport mechanism.

7 Claims, 5 Drawing Sheets

(56) References Cited

FOREIGN PATENT DOCUMENTS

| | | | |
|---|---|---|---|
| JP | 3581720 | B2 | 10/2004 |
| JP | 2006-293413 | A | 10/2006 |
| JP | 2009-169251 | A | 7/2009 |
| JP | 2009-244438 | A | 10/2009 |

OTHER PUBLICATIONS

Office Action (Notification of Reason for Refusal) dated Aug. 20, 2013, issued by the Japanese Patent Office in the corresponding Japanese Patent Application No. 2011-029480 and an English translation thereof. (8 pages).

* cited by examiner

IMAGE FORMING APPARATUS WITH A TONER RECOVERY UNIT

RELATED APPLICATION

The priority application Number Japanese Patent Application 2011-29480 upon which this application is based is hereby incorporated by reference.

BACKGROUND OF THE INVENTION

1. Field of the Invention

The present invention relates to an electrophotographic image forming apparatus such as copiers, printers, facsimiles and multi-functional peripherals thereof.

2. Description of the Related Art

The image forming apparatuses such as copiers, printers, facsimiles and multi-functional peripherals thereof are generally arranged such that a developing unit supplies a toner to an image carrier with an electrostatic latent image formed thereon, thereby forming a toner image on a surface of the image carrier in correspondence to the electrostatic latent image.

The above developing unit is known to include a developing unit of a mono-component development system which uses a toner alone as a developer and a developing unit of a two-component development system which uses a developer including the toner and a carrier. The developing unit of the two-component development system using the developer including the toner and the carrier is superior in terms of quick and adequate toner charging for facilitating high-speed image formation.

The above developing unit of the two-component development system normally takes the following steps to supply the toner for developing the electrostatic latent image formed on the image carrier. The developing unit mixes and agitates the developer including the toner and the carrier to thereby charge the toner present in the developer by contact with the carrier. The developer with the toner thus charged is retained on a developer carrier, which delivers the developer to a development position opposite the image carrier. The toner present in the developer retained on the developer carrier is supplied to the image carrier whereby the toner image corresponding to the electrostatic latent image is formed on the surface of the image carrier.

In a case where the developer is decreased in toner content in consequence of the above-described toner supply to the image carrier, a toner replenishing mechanism replenishes the developing unit with the toner.

After the toner image corresponding to the electrostatic latent image is formed on the image carrier by supplying the toner from the developing unit, a transfer unit operates to transfer the toner image formed on the image carrier to a transfer receiving body such as a recording medium or an intermediate transfer belt. After the transfer of the toner image, the toner remaining on the surface of the image carrier is recovered by a toner recovery unit.

More recently, there has been proposed an image forming apparatus adapted for effective use of the toner thus recovered by the toner recovery unit. In this apparatus, the toner recovered by the toner recovery unit is transported to a return transport mechanism by means of a recovered toner transporting member disposed in the toner recovery unit. The return transport mechanism returns the recovered toner to the developing unit.

Japanese Patent No. 3352399, for example, proposes an apparatus wherein the toner recovered by the toner recovery unit is transported by transport means to a recovered toner reservoir so as to be stored therein and wherein the recovered toner from the recovered toner reservoir and fresh toner from a fresh toner reservoir are blended in a proper ratio and the resultant toner mixture is supplied to the developing unit to be used for image development. The Japanese Patent No. 3352399 also proposes an arrangement to deal with a case where the toner collected in the recovered toner reservoir exceeds a predetermined volume. In such a case, a transport path for transporting the recovered toner is switched from the recovered toner reservoir to the fresh toner reservoir containing the fresh toner so that the toner collected in the recovered toner reservoir may not become agglomerated as subjected to pressure increase or the like.

The above-described developing unit of the two-component development system also has a problem that while the developer is used over an extended period of time, the carrier in the developer is gradually deteriorated to become incapable of adequately charging the toner. As a result, the developing unit fails to accomplish proper image formation.

More recently, therefore, there is a practice in the art to remove the above-described developer suffering the carrier deterioration from the developing unit for replacement with a fresh developer or to replace the developing unit per se with a new one.

However, in the case where the developer suffering the carrier deterioration is removed from the developing unit for replacement with the fresh developer or where the developing unit per se is replaced with the new one, the developer to be replaced actually contains a substantial amount of toner that is still usable. Namely, there is a problem that the usable toner remaining in the pre-replacement developer is wastefully discarded.

In this connection, Japanese Patent No. 3581720 discloses an apparatus wherein the above developing unit is provided with a developer recovery portion and a toner recovery portion as separation means for separating the toner from the developer being recovered. Specifically, a charge of the opposite polarity to that of the toner is applied to a developer recovery sleeve so as to separate the toner from the developer being recovered. The separated toner is recycled back into the operation.

However, the following problems exist with the apparatus wherein the developing unit is provided with the developer recovery portion and the toner recovery portion as the separation means for separating the toner from the developer being recovered and wherein the toner is separated from the developer being recovered by applying to the developer recovery sleeve the charge of the opposite polarity to that of the toner. That is, the developing unit requires much equipment which leads to cost increase. What is more, the developing unit is increased in size.

SUMMARY OF THE INVENTION

An image forming apparatus according to the invention comprises:

an image carrier on which a toner image is formed;

a developing unit for forming the toner image on the image carrier by driving a developer carrier to deliver to the image carrier a developer including a carrier and a toner, followed by supplying to the image carrier the toner present in the developer;

a transfer unit for transferring the toner image formed on the image carrier to a transfer receiving body;

a toner recovery unit for recovering the toner remaining on the surface of the image carrier after the transfer of the toner image;

a recovered toner transporting member for transporting, within the toner recovery unit, the toner recovered by the toner recovery unit;

a return transport mechanism for returning to the developing unit the toner transported thereto by the recovered toner transporting member; and a recovered toner reservoir disposed independently from the return transport mechanism and storing the toner transported thereto by the recovered toner transporting member.

These and other objects, advantages and features of the invention will become apparent from the following description thereof taken in conjunction with the accompanying drawings which illustrate specific embodiment of the invention.

DESCRIPTION OF THE PREFERRED EMBODIMENT

An image forming apparatus according to an embodiment of the invention will be specifically described with reference to the accompanying drawings. It is to be noted that the image forming apparatus of the invention is not limited to the following embodiment.

Figure 1:
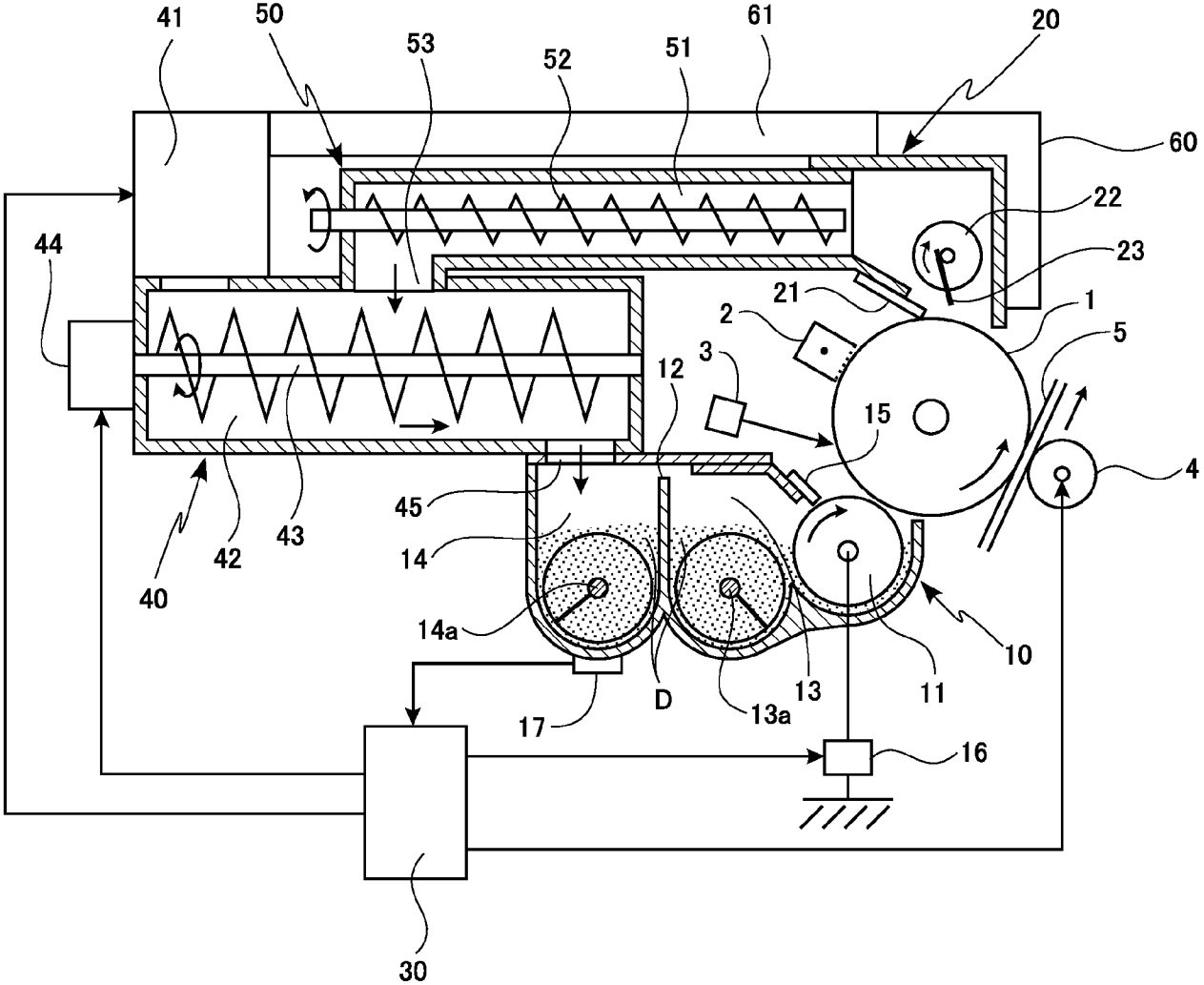
FIG. 1 is a schematic diagram illustrating an image forming apparatus according to one embodiment of the invention wherein image formation is accomplished by transferring a toner image formed on an image carrier to a transfer receiving body while a toner recovered by a toner recovery unit is returned to a developing unit by means of a return transport mechanism.

The image forming apparatus of this embodiment operates as follows. As shown in FIG. 1, a surface of an image carrier 1 comprising a rotary photosensitive drum is charged by a charger 2. Subsequently, a latent image forming unit 3 employing a laser or the like exposes the surface of the image carrier 1 to light according to image information, to thereby form an electrostatic latent image on surface of the image carrier 1.

A developing unit 10 containing therein a developer D including a toner and a carrier supplies the toner of the developer D to the electrostatic latent image formed on the surface of the image carrier 1. Thus, a toner image corresponding to the electrostatic latent image is formed on the image carrier 1.

Subsequently, the toner image thus formed on the image carrier 1 is transported to place opposite a transfer unit 4 in the form of a roller, while a transfer receiving body 5 such as a recording sheet or an intermediate transfer belt is brought into space between the image carrier 1 and the transfer unit 4. The toner image formed on the surface of the image carrier 1 is transferred to the transfer receiving body 5 by the transfer unit 4.

An end of a cleaning member 21 provided at a toner recovery unit 20 is pressed against the surface of the image carrier 1 after the image transfer. The toner remaining on the surface of the image carrier 1 is recovered by the cleaning member 21 and collected in the toner recovery unit 20.

A recovered toner transporting screw 22 as a recovered toner transporting member is disposed in the toner recovery unit 20 so that the toner collected in the toner recovery unit 20 is transported by rotating the recovered toner transporting screw 22.

The above developing unit 10 has a structure wherein a developer carrier 11 in the form of a rotary roller is rotatably disposed in an opposed relation to the above image carrier 1 and wherein a partition wall 12 is formed within the developing unit 10 in an axial direction of the developer carrier 11, thus partitioning the interior of the developing unit into a first developer transport portion 13 and a second developer transport portion 14. The first developer transport portion 13 and the second developer transport portion 14 are provided with a first agitating/transporting member 13*a* and a second agitating/transporting member 14*a* for agitating and transporting the developer D, respectively.

The above first agitating/transporting member 13*a* and second agitating/transporting member 14*a* are driven into rotation. In the first developer transport portion 13, the developer D is transported along the developer carrier 11 and supplied to the developer carrier 11. In the second developer transport portion 14, on the other hand, the developer D is transported in the opposite direction from the developer transported in the first developer transport portion 13 so as to be circulated between the second developer transport portion 14 and the first developer transport portion 13 via circulation ports (not shown) formed at opposite ends of the above partition wall 12.

The developing unit 10 supplies the toner of the developer D to an area of the electrostatic latent image formed on the surface of the image carrier 1, as described above, to thereby form on the image carrier 1 the toner image corresponding to the electrostatic latent image. In this process, the developer carrier 11 is driven into rotation to carry thereon the developer D toward the image carrier 1. Further, the amount of developer D carried on the developer carrier 11 and to the image carrier 1 is regulated by a regulating member 15 opposed to the developer carrier 11 via a predetermined gap therebetween.

The developer carrier 11 carries thereon the developer D so regulated to place opposite the image carrier 1, while a controller 30 operates a bias voltage source 16 to apply a proper developing bias voltage to space between the developer carrier 11 and the image carrier 1. Thus, the toner of the developer D delivered to place opposite the image carrier 1 is supplied to the area of the electrostatic latent image formed on the surface of the image carrier 1, whereby the toner image corresponding to the electrostatic latent image is formed on the surface of the image carrier 1.

In this developing unit 10, the second developer transport portion 14 described above is provided with a toner density sensor 17 for detecting a toner content of the developer D. With a detectable decrease in the toner content of the developer D in the developing unit 10 as a result of supplying the toner of the developer D to the surface of the image carrier 1 as described above, the toner density sensor 17 detects such decreased toner content and outputs a detection result to the controller 30.

In a case where the toner content of the developer D in the developing unit 10 falls to a predetermined value or less, the controller 30 actuates a toner replenishing mechanism 40 so as to supply a toner replenishment path 42 with a fresh toner from a toner cartridge 41 containing the fresh toner therein. A toner transporting member 43 comprising a screw member disposed in the toner replenishment path 42 is rotated by a rotary unit 44 for transporting the toner thus fed into the toner replenishment path 42. The toner is delivered to a toner supply port 45 defined between the toner replenishment path 42 and the second developer transport portion 14. Through this toner supply port 45, the fresh toner is fed into the developing unit 10.

Figure 2:
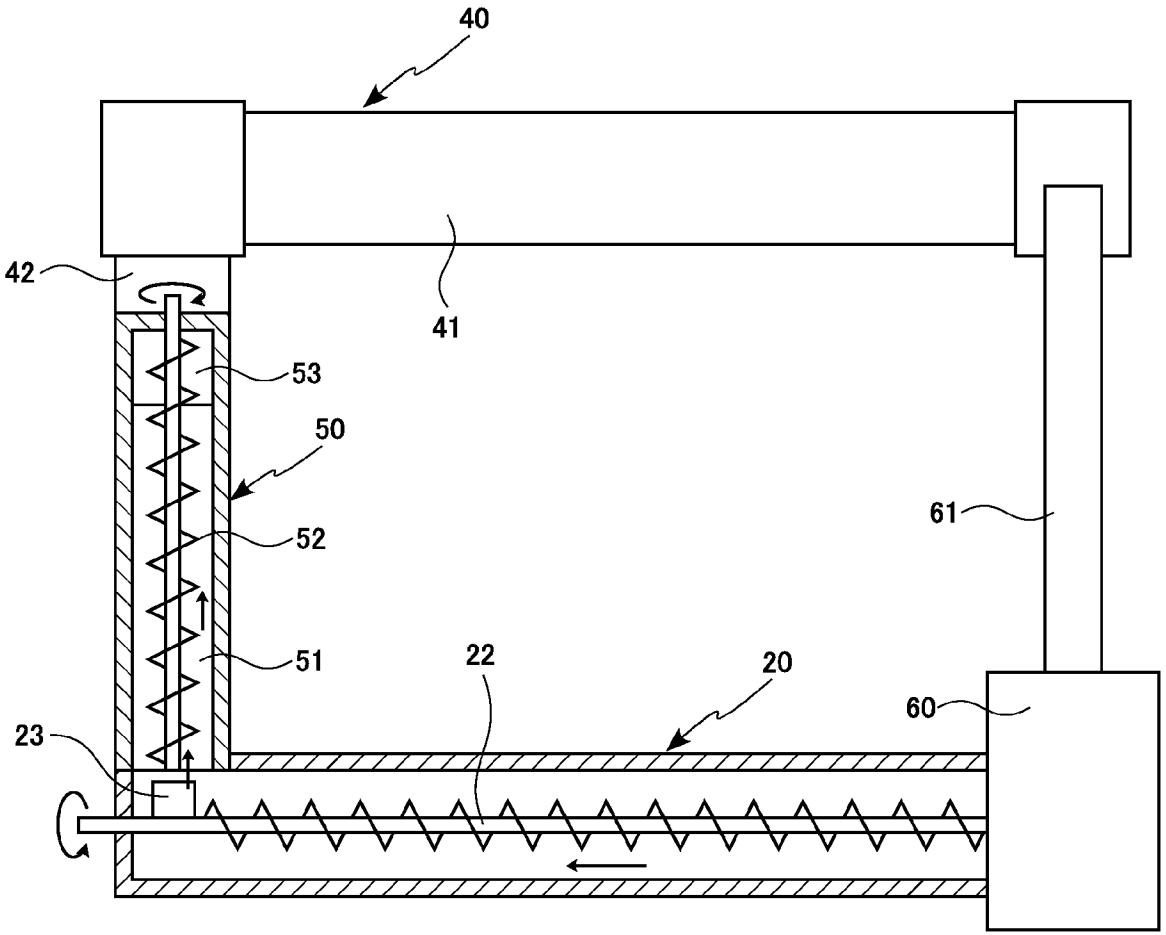
FIG. 2 is a fragmentary sectional view illustrating the image forming apparatus of the above embodiment wherein the toner recovered by the toner recovery unit is fed into a return transport path of the return transport mechanism by means of a recovered toner transporting screw.

The toner collected in the toner recovery unit 20 as described above is returned to the developing unit 10 as follows by means of a return transport mechanism 50. As shown in FIG. 1 and FIG. 2, the recovered toner transporting screw 22 in the toner recovery unit 20 is rotated in a predetermined direction to transport the toner collected in the toner recovery unit 20 toward a return transport path 51 in the return transport mechanism 50. Specifically, a feed vane fixed to the recovered toner transporting screw 22 feeds the recovered toner into the return transport path 51.

Next, a screw member 52 disposed in the return transport path 51 is rotated so that the above toner fed into the return transport path 51 is transported through this return transport path 51 to a recovered toner inlet port 53 defined between the return transport path 51 and the above-described toner replenishment path 42. The recovered toner is fed into the toner replenishment path 42 through this recovered toner inlet port 53.

Similarly to the fresh toner replenished from the toner cartridge 41, the above toner fed from the return transport path 51 into the toner replenishment path 42 is transported by the toner transporting member 43 disposed in the toner replenishment path 42. The toner is delivered to the toner supply port 45 defined between the toner replenishment path 42 and the second developer transport portion 14 and is returned to the developing unit 10 through this toner supply port 45.

While the developing unit 10 continues to develop images in the above-described manner, the developer D is kept mixed and agitated by the first agitating/transporting member 13*a* and the second agitating/transporting member 14*a* so that the carrier in the developer D is gradually deteriorated. Accordingly, the toner in the developer D fails to be properly charged so that the developing unit becomes incapable of accomplishing favorable image formation. Therefore, the apparatus is adapted to prompt a user to replace the developer D in the developing unit 10 with a fresh developer D or to replace the developing unit 10 per se with a new developing unit 10 in the case where the carrier in the developer D is deteriorated.

According to the image forming apparatus of this embodiment, a toner recovery operation for recovering the toner from the developer D loaded in the developing unit 10 and suffering the carrier deterioration is performed by the toner recovery unit 20 before the developer D in the developing unit is replaced with the fresh developer D or before the developing unit 10 per se is replaced with the new one.

Figure 3:
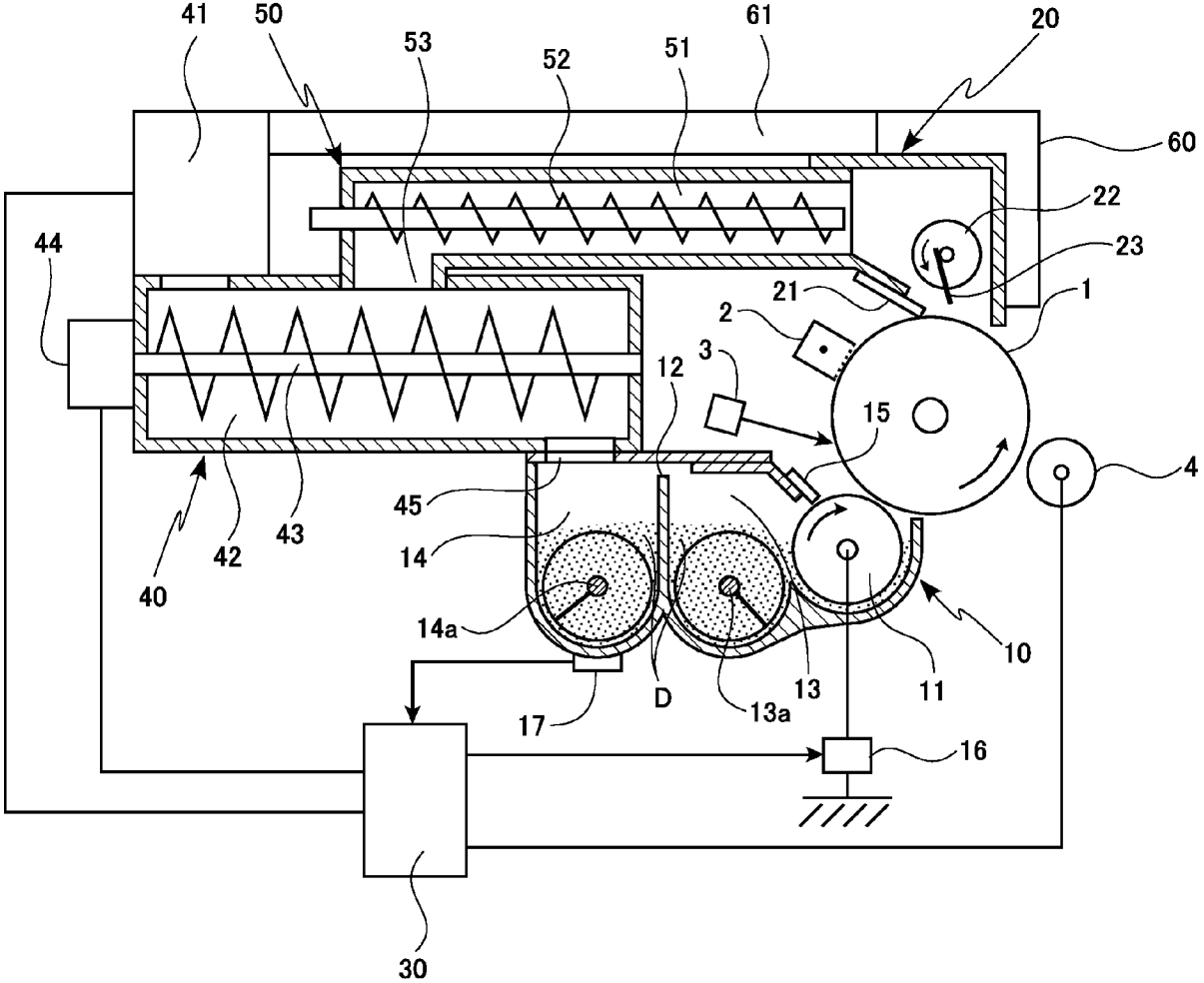
FIG. 3 is a schematic diagram illustrating the image forming apparatus of the above embodiment wherein the toner supplied to the image carrier is inhibited from being transferred onto the transfer receiving body thereby permitting the toner recovery unit to recover the toner, while the toner recovered by the toner recovery unit is stored in a recovered toner reservoir.

According to the image forming apparatus of the embodiment, the toner recovery operation for recovering the toner present in the developer D in the developing unit 10 is performed as follows. As shown in FIG. 3, the surface of the image carrier 1 is charged by the charger 2, then exposed to light by the latent image forming unit 3 whereby an electrostatic latent image defining a solid image or the like to be supplied with the largest possible amount of toner is formed on the surface of the image carrier 1.

The embodiment provides the following control when the above-described developing unit 10 supplies the toner of the developer D to the electrostatic latent image thus formed on the surface of the image carrier 1. A developing bias voltage which the bias voltage source 16 applies between the developer carrier 11 and the image carrier 1 is controlled by the controller 30 in a manner such that the developing bias voltage active in the direction to feed the toner to the image carrier 1 is increased from a level of the normal image formation. This makes the toner present in the developer D efficiently supplied to the surface of the image carrier 1.

After the toner is supplied to the surface of the image carrier 1 as described above, the transfer receiving body 5 is inhibited from being brought into space between the image carrier 1 supplied with the toner and the transfer unit 4, while the image carrier 1 and the transfer unit 4 are spaced apart, as shown in FIG. 3. Namely, the toner supplied to the image carrier 1 is not transferred onto the transfer receiving body 5 but transported to the toner recovery unit 20.

Figure 4:
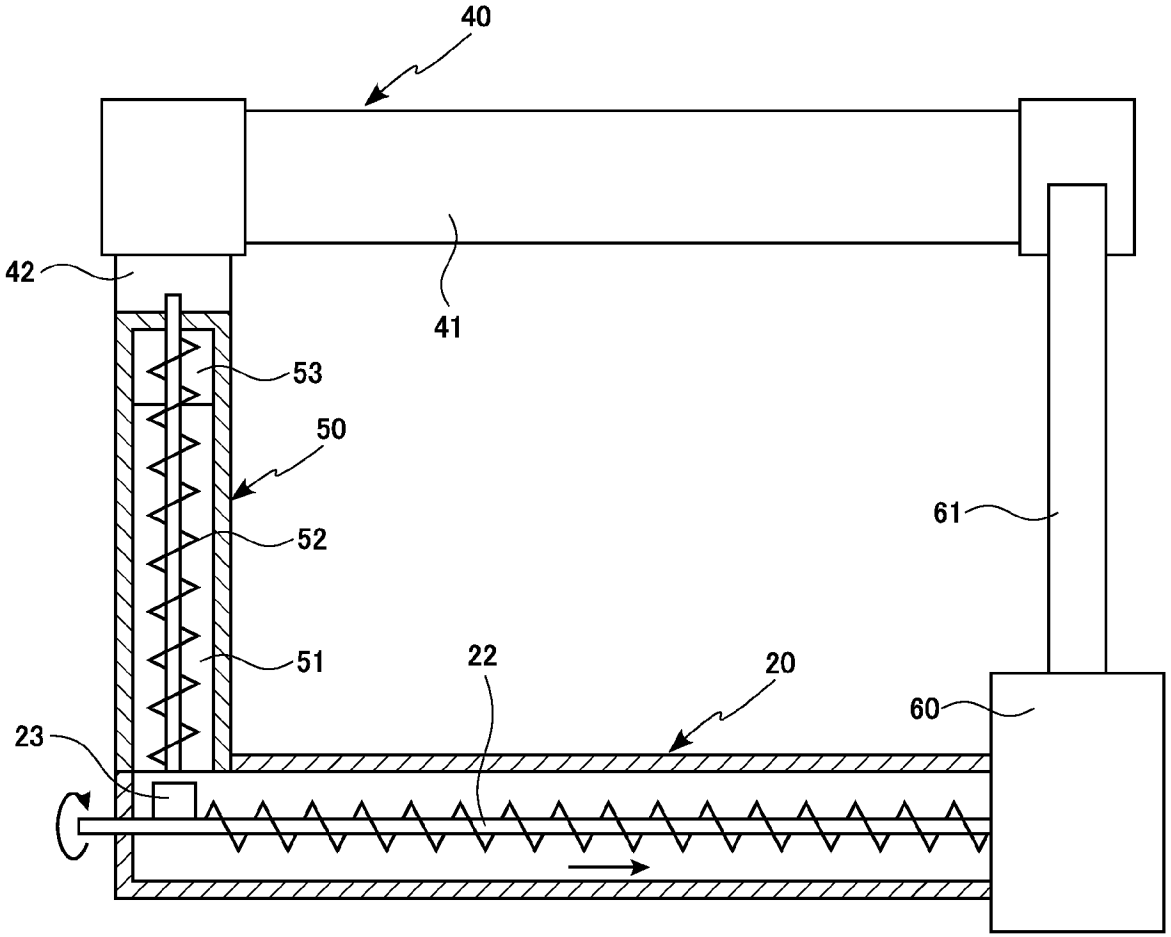
FIG. 4 is a fragmentary sectional view illustrating the image forming apparatus of the above embodiment wherein the recovered toner transporting screw transports the toner recovered by the toner recovery unit to the opposite side from the return transport mechanism, so as to permit the recovered toner reservoir to store the recovered toner therein.

According to the above-described toner recovery unit 20, the toner supplied to the surface of the image carrier 1 as described above is recovered by the cleaning member 21. Furthermore, as shown in FIG. 4, the above-described recovered toner transporting screw 22 in this toner recovery unit 20 is rotated in the opposite direction from the rotation during the image formation. Namely, the recovered toner transporting screw 22 transports the recovered toner through the toner recovery unit 20 in the opposite direction from the return transport path 51 or toward a recovered toner reservoir 60. Thus, the recovered toner is stored in the recovered toner reservoir 60.

By performing this operation, the toner present in the developer D loaded in the developing unit 10 is sequentially supplied to the image carrier 1 so as to be recovered by the toner recovery unit 20. The toner so recovered is stored in the recovered toner reservoir 60 while the developer D loaded in the developing unit 10 is gradually lowered in the toner content.

The amount of toner remaining in the developer D is decreased in this manner. When the density of the toner present in the developer D is decreased to a predetermined value or less as detected by the above-described toner density sensor 17, the sensor outputs this detection result to the controller 30. In this state, the controller 30 prompts the user to replace the developer D in the developing unit 10 with the fresh developer D. Alternatively, the controller may prompt the user to replace the developing unit 10 per se with the new developing unit 10. According to this method, the developer D to be replaced is decreased in the toner content so that the amount of wastefully discarded toner is dramatically reduced.

Figure 5:
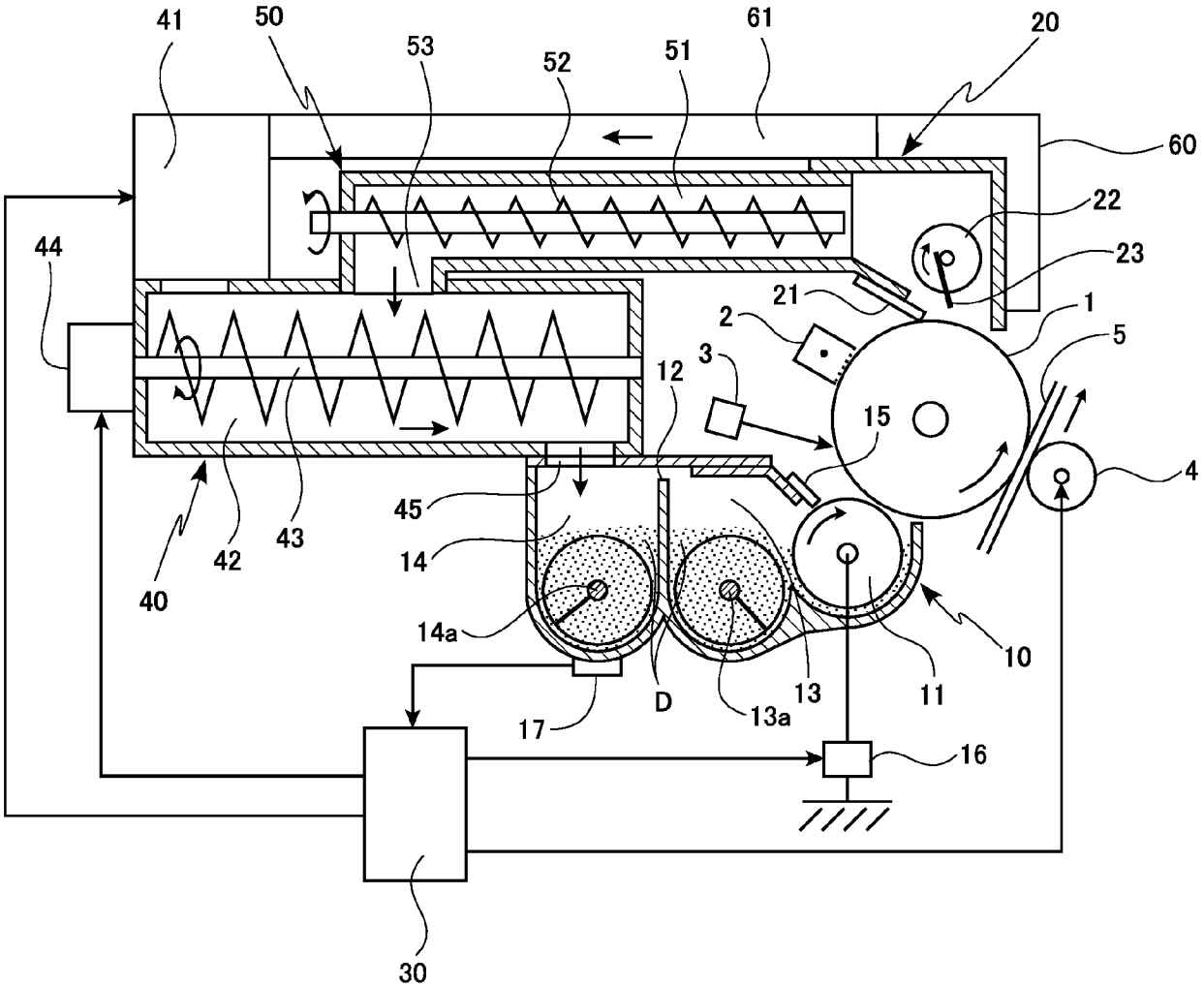
FIG. 5 is a schematic diagram illustrating the image forming apparatus of the above embodiment wherein the image formation is accomplished by transferring the toner image formed on the image carrier to the transfer receiving body while the toner stored in the recovered toner reservoir is fed into a toner replenishing mechanism by a recovered toner supply mechanism.

After the developer D in the developing unit 10 is replaced with the fresh developer D or the developing unit 10 per se is replaced with the new developing unit 10, as described above, the toner stored in the above recovered toner reservoir 60 is supplied to the above-described toner cartridge 41 by means of a recovered toner supply mechanism 61 provided with a rotary screw member (not shown) or the like, as shown in FIG. 5. This toner, along with the fresh toner stored in the toner cartridge 41, is supplied to the developing unit 10 via the toner replenishment path 42. This facilitates effective use of the above-described toner recovered from the pre-replacement developer D by the toner recovery unit 20 and stored in the recovered toner reservoir 60.

This embodiment is arranged such that the toner stored in the recovered toner reservoir 60 is supplied to the toner cartridge 41 by means of the recovered toner supply mechanism 61. However, an alternative arrangement may also be made wherein the recovered toner supply mechanism 61 directly supplies the toner replenishment path 42 with the toner stored in the recovered toner reservoir 60.

In the image forming apparatus of the invention, the residual toner on the surface of the image carrier is recovered by the toner recovery unit while the recovered toner is transported by the recovered toner transporting member disposed in the toner recovery unit. According to this image forming apparatus, the recovered toner transporting member is adapted to transport the recovered toner not only to the return transport mechanism serving to return the recovered toner to the developing unit, but also to the recovered toner reservoir.

Therefore, the image forming apparatus of the invention can take the following measure to deal with the case where the developer loaded in the developing unit suffers the carrier deterioration so that the developer in the developing unit is replaced with the fresh developer or that the developing unit per se is replaced with a new one. Namely, the toner recovery unit recovers the toner from the surface of the image carrier while the recovered toner transporting member transports the recovered toner to the recovered toner reservoir for storage, which is provided independently from the return transport mechanism.

According to the image forming apparatus of the invention, therefore, the toner present in the pre-replacement developer suffering the carrier deterioration is properly recovered from the developing unit and stored in the recovered toner reservoir so that the pre-replacement developer in the developing unit is gradually decreased in the toner content. In case that the developer is replaced with the fresh developer, the image forming apparatus can efficiently recover the toner present in the pre-replacement developer without employing a special device, facilitating the prevention of wasteful discarding of the toner. Furthermore, the image forming apparatus can also obviate a problem that the toner recovered by the toner recovery unit accumulates and gets jammed in the toner recovery unit or the return transport mechanism.

If the image forming apparatus of the invention has a structure wherein the toner replenishing mechanism for replenishing the developing unit with the toner is provided and wherein the recovered toner supply mechanism is used to supply the toner replenishing mechanism with the toner stored in the above-described recovered toner reservoir, the toner stored in the recovered toner reservoir is supplied to the developing unit via the toner replenishing mechanism.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

What is claimed is:

1. An image forming apparatus comprising:

an image carrier on which a toner image is formed;

a developing unit for forming the toner image on the image carrier by driving a developer carrier to deliver to the image carrier a developer including a carrier and a toner, followed by supplying to the image carrier the toner present in the developer;

a transfer unit for transferring the toner image formed on the image carrier to a transfer receiving body;

a toner recovery unit for recovering the toner remaining on the surface of the image carrier after the transfer of the toner image;

a recovered toner transporting member for transporting, within the toner recovery unit, the toner recovered by the toner recovery unit;

a return transport mechanism for returning to the developing unit the toner transported thereto by the recovered toner transporting member; and a recovered toner reservoir disposed independently from the return transport mechanism and storing the toner transported thereto by the recovered toner transporting member; and a recovered toner supply mechanism for returning to the developing unit the toner stored in the recovered toner reservoir.

2. The image forming apparatus according to claim 1, wherein a toner recovery operation for recovering the toner from the developer in the developing unit and collecting the recovered toner in the recovered toner reservoir is performed by driving the recovered toner transporting member to transport the toner recovered by the toner recovery unit to the recovered toner reservoir disposed independently from the return transport mechanism and allowing the recovered toner reservoir to store the recovered toner.

3. The image forming apparatus according to claim 2, wherein the toner supplied from the developer carrier to the image carrier is inhibited from being transferred onto the transfer receiving body during the toner recovery operation.

4. The image forming apparatus according to claim 2, wherein the toner recovery operation is performed before the replacement of the developer in the developing unit or before the replacement of the developing unit per se.

5. An image forming apparatus comprising:

an image carrier on which a toner image is formed;

a developing unit for forming the toner image on the image carrier by driving a developer carrier to deliver to the image carrier a developer including a carrier and a toner, followed by supplying to the image carrier the toner present in the developer;

a transfer unit for transferring the toner image formed on the image carrier to a transfer receiving body;

a toner recovery unit for recovering the toner remaining on the surface of the image carrier after the transfer of the toner image;

a recovered toner transporting member for transporting, within the toner recovery unit, the toner recovered by the toner recovery unit;

a return transport mechanism for returning to the developing unit the toner transported thereto by the recovered toner transporting member; and a recovered toner reservoir disposed independently from the return transport mechanism and storing the toner transported thereto by the recovered toner transporting member;

wherein the toner is supplied from the developer carrier to the image carrier by applying a developing bias voltage to space between the developer carrier and the image carrier and wherein the developing bias voltage for supplying the toner from the developer carrier to the image carrier is increased during the toner recovery operation.

6. The image forming apparatus according to claim 5, wherein a toner recovery operation for recovering the toner from the developer in the developing unit and collecting the recovered toner in the recovered toner reservoir is performed by driving the recovered toner transporting member to transport the toner recovered by the toner recovery unit to the recovered toner reservoir disposed independently from the return transport mechanism and allowing the recovered toner reservoir to store the recovered toner.

7. An image forming apparatus comprising:

an image carrier on which a toner image is formed;

a developing unit for forming the toner image on the image carrier by driving a developer carrier to deliver to the image carrier a developer including a carrier and a toner, followed by supplying to the image carrier the toner present in the developer;

a transfer unit for transferring the toner image formed on the image carrier to a transfer receiving body;

a toner recovery unit for recovering the toner remaining on the surface of the image carrier after the transfer of the toner image;

a recovered toner transporting member for transporting, within the toner recovery unit, the toner recovered by the toner recovery unit;

a return transport mechanism for returning to the developing unit the toner transported thereto by the recovered toner transporting member; and a recovered toner reservoir disposed independently from the return transport mechanism and storing the toner transported thereto by the recovered toner transporting member;

wherein a recovered toner transporting screw which is rotated to transport the recovered toner is employed as the recovered toner transporting member and wherein the toner recovered by the toner recovery unit is transported by the recovered toner transporting screw either to the return transport mechanism or the recovered toner reservoir by changing the rotational direction of the recovered toner transporting screw.

* * * * *